US011008956B2

(12) United States Patent
Song

(10) Patent No.: US 11,008,956 B2
(45) Date of Patent: May 18, 2021

(54) VARIABLE COMPRESSION RATIO-APPLIED CONTROL SYSTEM USING ADAS AND CONTROL METHOD THEREOF

(71) Applicants: HYUNDAI MOTOR COMPANY, Seoul (KR); KIA MOTORS CORPORATION, Seoul (KR)

(72) Inventor: Jae-Hyeok Song, Incheon (KR)

(73) Assignees: Hyundai Motor Company, Seoul (KR); KIA Motors Corporation, Seoul (KR)

( * ) Notice: Subject to any disclaimer, the term of this patent is extended or adjusted under 35 U.S.C. 154(b) by 0 days.

(21) Appl. No.: 16/697,790

(22) Filed: Nov. 27, 2019

(65) Prior Publication Data

US 2020/0284210 A1 Sep. 10, 2020

(30) Foreign Application Priority Data

Mar. 7, 2019 (KR) ..... 10-2019-0026248

(51) Int. Cl.
*F02D 15/02* (2006.01)
*F02D 29/02* (2006.01)

(52) U.S. Cl.
CPC ..... *F02D 15/02* (2013.01); *F02D 29/02* (2013.01); *F02D 2200/501* (2013.01); *F02D 2200/602* (2013.01); *F02D 2200/70* (2013.01)

(58) Field of Classification Search
CPC ..... F02D 15/02; F02D 29/02; F02D 2200/70; F02D 2200/602; F02D 2200/501; F02D 41/0215; F02D 2200/702; F02D 41/08; F02D 2200/50; F02D 41/021
See application file for complete search history.

(56) References Cited

U.S. PATENT DOCUMENTS 6,622,810 B2 * 9/2003 Labuhn ..... B60K 31/0008 180/169
2013/0055990 A1 * 3/2013 Kamada ..... F02D 15/00 123/48 R
2013/0118455 A1 5/2013 Woo et al.
2020/0086749 A1 * 3/2020 Suzuki ..... B60L 58/13

FOREIGN PATENT DOCUMENTS

KR 10-2013-0052871 A 5/2013

* cited by examiner

*Primary Examiner* — Joseph J Dallo
(74) *Attorney, Agent, or Firm* — Brinks Gilson & Lione

(57) ABSTRACT

A variable compression ratio-applied control system using an ADAS and a control method thereof are provided. The system includes a driver assist unit for measuring the distance and the relative speed with a preceding vehicle, and a compression ratio changing unit for changing a compression ratio during traveling, and a neutral control mode for blocking power transfer by a transmission during traveling is implemented, a compression ratio changing unit is operated by using the information acquired through the driver assist unit in a state where the neutral control mode has been implemented, and the compression ratio is changed during inertia traveling during which the neutral control mode has been implemented.

16 Claims, 7 Drawing Sheets

VARIABLE COMPRESSION RATIO-APPLIED CONTROL SYSTEM USING ADAS AND CONTROL METHOD THEREOF

CROSS-REFERENCE TO RELATED APPLICATION

The present application claims priority to and the benefit of Korean Patent Application No. 10-2019-0026248, filed on Mar. 7, 2019, which is incorporated herein by reference in its entirety.

TECHNICAL FIELD

The present disclosure relates to a variable compression ratio-applied control system using an ADAS and a control method thereof, and more particularly, to a variable compression ratio-applied control system using an ADAS and a control method thereof in which a compression ratio is changed during neutral stage inertia traveling.

BACKGROUND

The statements in this section merely provide background information related to the present disclosure and may not constitute prior art.

Generally, an engine block, a cylinder head, and a connecting rod that form an engine are determined in size at the time of manufacture. Therefore, a compression ratio obtained by dividing the volume of a cylinder and the volume of a combustion chamber by the volume of the cylinder could not be changed.

When the compression ratio is high, the thermal efficiency increases but the friction increases, thereby occurring knocking or misfiring. Meanwhile, as illustrated in FIG. 1, when the engine is operated at a specific RPM, the fuel efficiency is enhanced as the load is increased. Therefore, there has been a study for enhancing the fuel efficiency by increasing the compression ratio when the engine load is small.

Therefore, as illustrated in FIG. 2, a variable compression ratio technology for mounting a link structure 2 on a connecting rod 1 to change the stroke length of a piston head has emerged.

However, when the compression ratio is changed by the variable compression ratio technique, the torque temporarily becomes unstable, and the combustion noise is changed, thereby causing a driver to feel the vehicle failure. Particularly, when the compression ratio was changed, the RPM of the engine was instantaneously changed in order to keep the current torque, such that an impact similar to the shift impact was transferred to the driver. When changing from a low compression ratio to a high compression ratio, the engine operating sound was changed as the explosion pressure increased, thereby causing the driver to feel instability of the engine failure.

SUMMARY

The present disclosure provides a variable compression ratio-applied control system using an ADAS and a control method thereof in which a driver feels no sense of heterogeneity suspicious of the vehicle failure when a compression ratio is changed.

In addition, the present disclosure provides a variable compression ratio-applied control system using an ADAS and a control method thereof, which inhibit abrasion and damage of a compression ratio changing unit and an engine as the compression ratio is changed.

In addition, the present disclosure provides a variable compression ratio-applied control system using an ADAS and a control method thereof, which can improve the timing of changing the compression ratio by utilizing a driver assist unit and further enhance the fuel efficiency.

A variable compression ratio-applied control system using an ADAS in one form of the present disclosure includes a driver assist unit for measuring vehicle surroundings, a compression ratio changing unit for changing a compression ratio, and a control unit for implementing a neutral control mode, and the control unit implements a neutral control mode during inertia traveling, and changes the compression ratio by operating the compression ratio changing unit by using the distance and the relative speed with the preceding vehicle acquired through the driver assist unit.

In addition, the control unit can implement the neutral control mode when the distance and the relative speed with the preceding vehicle are equal to or greater than a setting value.

In addition, the control unit can calculate an inertia travelable time from the distance and the relative speed with the preceding vehicle.

In addition, the compression ratio changing unit can change the compression ratio, when it is determined that the inertia travelable time calculated in the control unit is equal to or greater than a target value.

In addition, the control unit can determine that the compression ratio is required to be changed based on a compression ratio changing request map.

In addition, the target value can be input to the control unit through calibration.

A variable compression ratio-applied control method using an ADAS in one form of the present disclosure includes implementing a neutral control mode during inertia traveling, obtaining the duration time of the neutral control mode, and changing a compression ratio according to the duration time of the neutral control mode, and the implementing the neutral control mode includes measuring the distance and the relative speed with the preceding vehicle through the driver assist unit, and calculating an inertia travelable time, and determining whether the distance and the relative speed with the preceding vehicle are equal to or greater than a setting value, and shifting a transmission to a neutral position.

In addition, the obtaining the duration time of the neutral control mode can include recording the distance and the relative speed with the preceding vehicle, and confirming the opening amounts of the brake pedal and the accelerator pedal, determining whether the opening amounts of the brake pedal and the accelerator pedal are zero, and determining whether the inertia travelable time is equal to or greater than a target value.

In addition, in the determining whether the opening amount of the pedal is zero, when it is determined that the opening amounts of the brake pedal and the accelerator pedal are not zero, the neutral control mode may be released and the required torque necessary for traveling may be confirmed.

In addition, in the determining whether the inertia travelable time is equal to or greater than the target value, when the inertial travelable time is smaller than the target value, the recording the distance and the relative speed with the preceding vehicle, and confirming the opening amounts of the brake pedal and the accelerator pedal can be performed again.

In addition, the changing the compression ratio can include confirming an engine torque, the distance and the relative speed with the preceding vehicle, and the gradient of the traveling road immediately before the neutral control mode is implemented, determining whether the compression ratio is required to be changed, operating a compression ratio changing unit and changing the compression ratio, and determining whether the compression ratio has been changed.

In addition, in the determining whether the compression ratio is required to be changed, when it is determined that the compression ratio is not required to be changed, the confirming the engine torque, the distance and the relative speed with the preceding vehicle, and the gradient of the traveling road immediately before the neutral control mode is implemented can be performed again.

In addition, in the determining whether the compression ratio has been changed, when it is determined that the compression ratio has not been changed, the confirming the engine torque, the distance and the relative speed with the preceding vehicle, and the gradient of the traveling road immediately before the neutral control mode is implemented can be performed again after a certain time stand-by.

In addition, in the determining whether the compression ratio is required to be changed, it can be determined whether the compression ratio is required to be changed based on a compression ratio changing request map.

In addition, in the determining whether the compression ratio is required to be changed, when it is determined to be accelerated or traveled at a high speed, it is determined to be currently traveling after rapid acceleration, it is determined to be currently in the long uphill traveling state, or it is determined to be traveling in a cold condition, it can be determined that the compression ratio is required to be changed to be reduced.

In addition, in the determining whether the compression ratio is required to be changed, when it is determined to be decelerated or traveled at a low speed, it is determined to be currently traveling after rapid deceleration, or it is determined to be currently in the long downhill traveling state, it can be determined that the compression ratio is required to be changed to be increased.

In some forms of the present disclosure, the variable compression ratio-applied control system using an ADAS configured as described above and the control method thereof, since the compression ratio is changed during the inertial traveling in which the neutral control mode has been implemented, the impact due to the change in the compression ratio is not transferred to the driver, and it is difficult for the driver to recognize the change in the engine operating sound because the engine operating sound is small. Therefore, the driver feels no sense of heterogeneity suspicious of the vehicle failure when the compression ratio is changed.

In addition, since the compression ratio is changed during the neutral control mode in which the engine load is small, the mechanical load is inhibited when the compression ratio is changed, thereby minimizing abrasion and damage of the compression ratio changing unit and the engine.

In addition, since it is determined whether the compression ratio is required to be changed from the information acquired through the driver assist unit, the compression ratio changing point can be optimized. In addition, since the variable compression ratio holding time is improved, the fuel efficiency due to the increase in the compression ratio at the engine low load is also enhanced.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
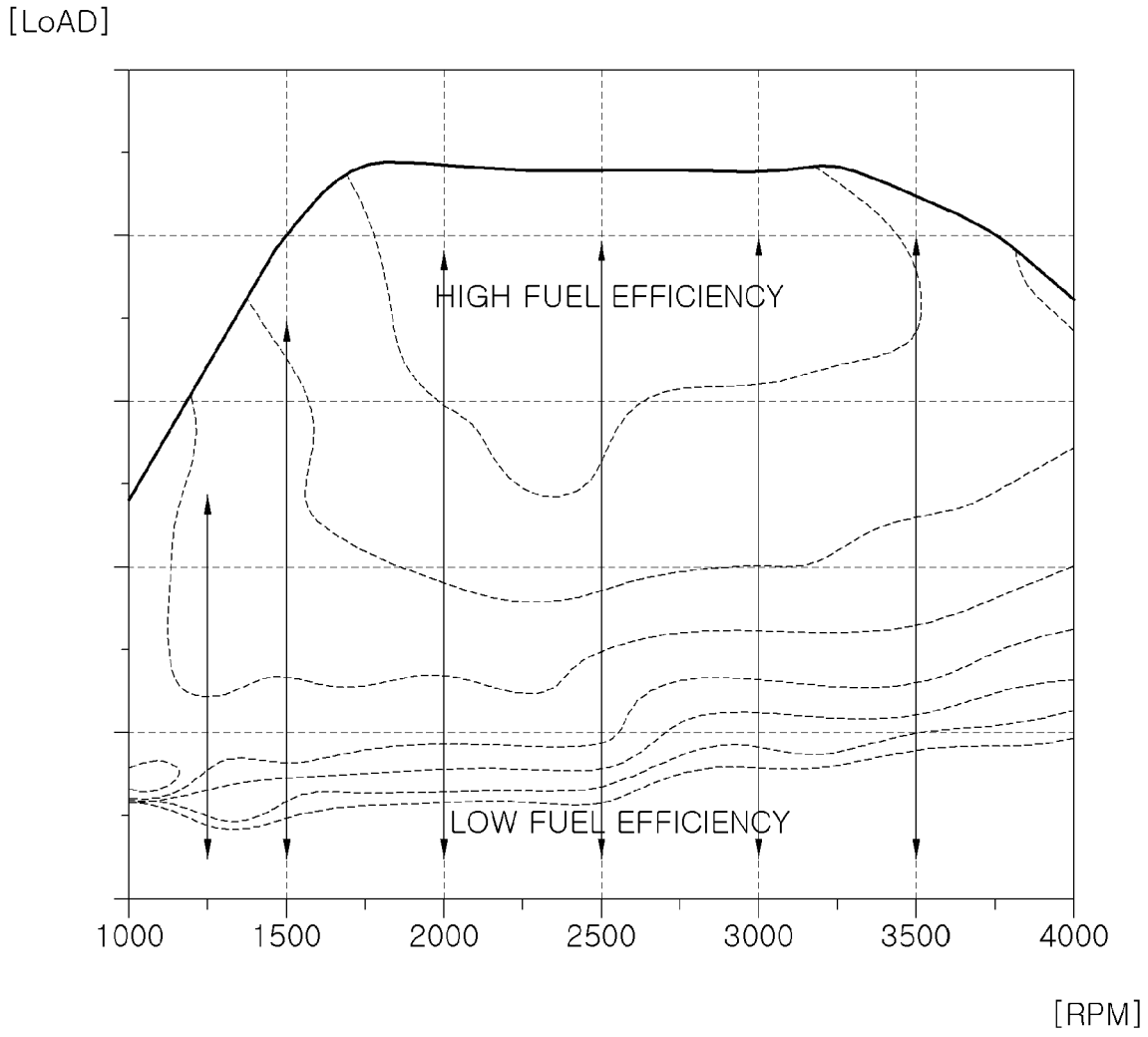
FIG. 1 is a graph illustrating the relationship of an engine RPM and an engine load.
Figure 2:
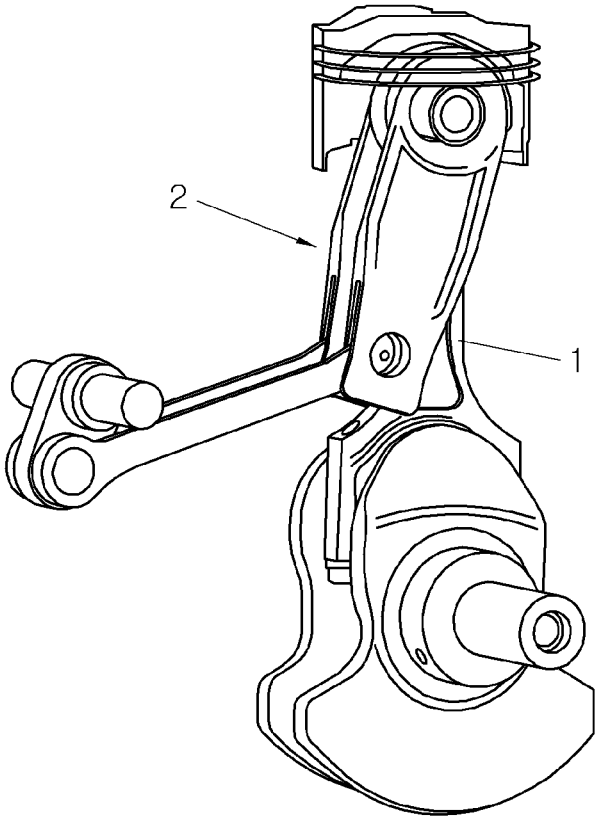
FIG. 2 is a diagram illustrating a link structure mounted on a connecting rod for changing a compression ratio.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 3:
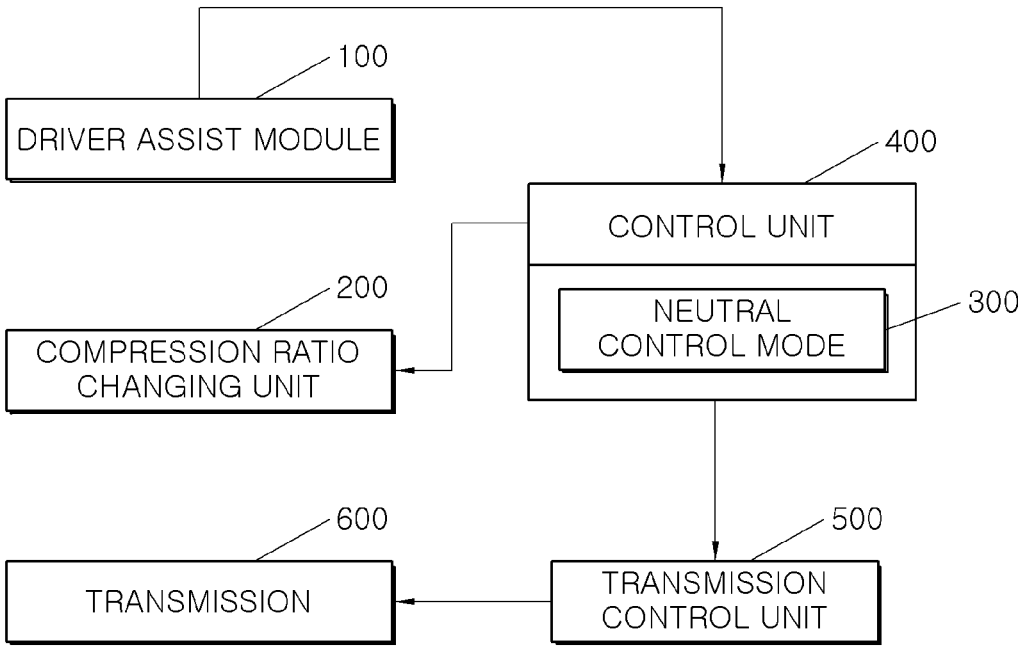
FIG. 3 is a block diagram illustrating a variable compression ratio-applied control system using an ADAS in one form of the present disclosure.
Figure 4:
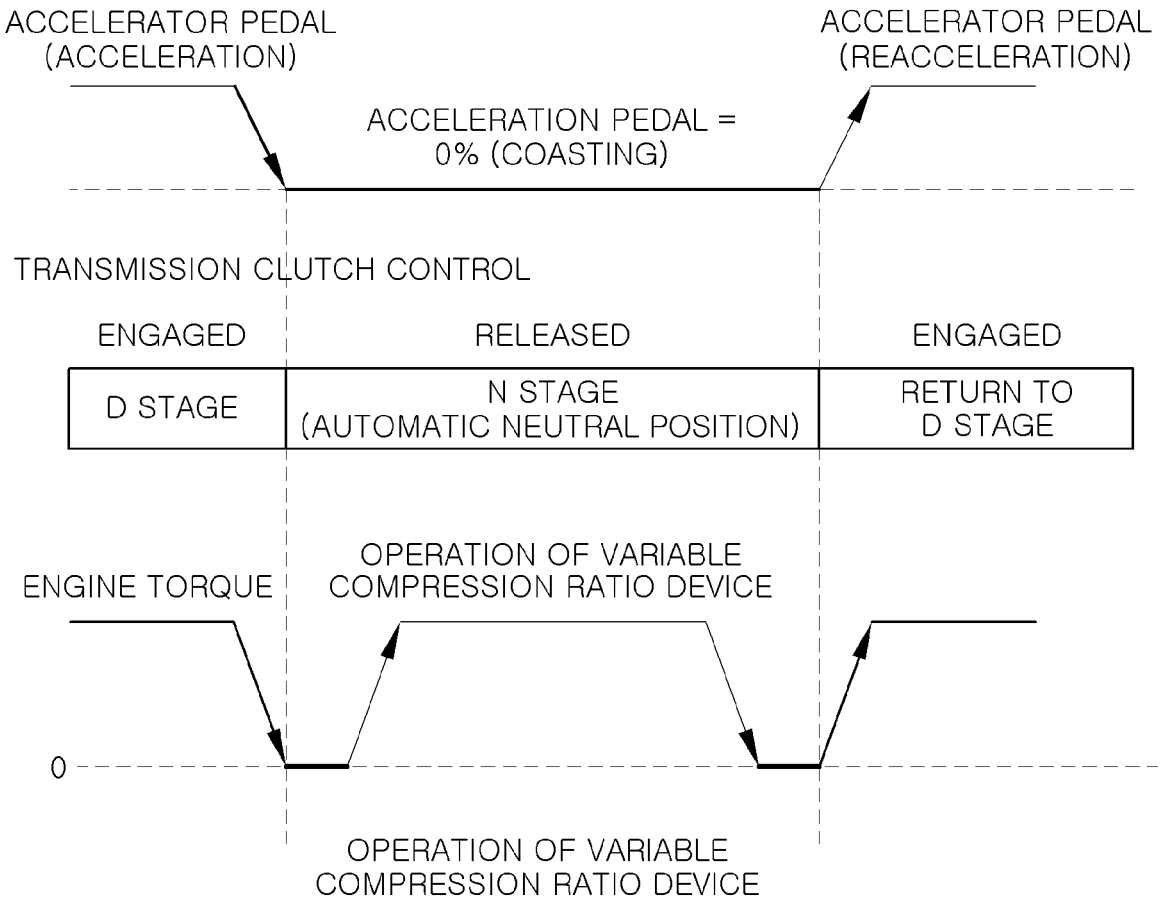
FIG. 4 is a graph illustrating an operating state of the variable compression ratio-applied control system using the ADAS of FIG. 3.

As illustrated in FIGS. 3 and 4, a variable compression ratio-applied control system using an ADAS in some forms of the present disclosure includes a driver assist unit 100 for measuring vehicle surroundings, and a compression ratio changing unit 200 for changing a compression ratio.

The variable compression ratio-applied control system using the ADAS in some forms of the present disclosure is applied to a vehicle in which a neutral control mode 300 for blocking power transfer by a transmission 600 during traveling is implemented.

The variable compression ratio-applied control system using the ADAS in some forms of the present disclosure operates the compression ratio changing unit 200 by using the distance and the relative speed with the preceding vehicle acquired through the driver assist unit 100 in a state where the neutral control mode 300 has been implemented.

The driver assist unit 100 includes an image sensor for generating image information among surrounding vehicle information, an object recognition sensor for generating the information such as an inter-vehicle distance and a speed among surrounding vehicle information, etc. Examples of the image sensor include a Complementary Metal-Oxide Semiconductor (CMOS) camera, a Charge-coupled Device (CCD) camera, etc. The object recognition sensor can be a lidar, a radar, or etc.

Particularly, the driver assist unit 100 can be an Advanced Driver Assistance System (ADAS). The ADAS performs various functions for assisting the driver such as a Forward Collision-Avoidance Assist (FCA) for warning the driver of danger when suddenly approaching the vehicle ahead or there is a danger of colliding with a pedestrian and braking and steering by itself, a Lane Keeping Assist (LKA) for helping to avoid leaving the lane, a Blind-Spot Collision-Avoidance Assist (BCA) for alarming whether there is another vehicle in the rear blind spot that is not visible when changing the lane, a Smart Cruise Control (SCC) for traveling by adjusting the distance to the preceding vehicle, and a Surround View Monitor (SVM) for showing surrounding situations with a front view, a rear view, a top view, etc. at the time of parking and departure.

The sizes of an engine block and a cylinder head are determined at the time of manufacture. Therefore, in order to change the compression ratio obtained by dividing the sum of the volume of a cylinder and the volume of a combustion chamber by the volume of the cylinder, it is preferable to change the stroke of a piston head forming the combustion chamber to change the volume of the combustion chamber.

The compression ratio changing unit 200 includes a link structure mounted on a piston to change the stroke length of the piston head. According to an example, the link structure can be embedded inside the connecting rod, or disposed at one side of the connecting rod in order to be disposed inside the cylinder block. The link structure includes an actuator for relatively rotating each link with respect to a reference point. The actuator can be operated through pneumatic pressure or electricity.

The neutral control mode 300 is provided to the vehicle as a program in a state stored in a control unit 400. The control unit 400 receives signals from various sensors mounted on the vehicle. The control unit 400 shifts the transmission 600 to a neutral stage by executing the neutral control mode 300, when the distance and the relative speed with the preceding vehicle during inertial traveling are equal to or greater than the setting value. At this time, the control unit 400 transmits a command signal to a transmission control unit 500 in the neutral control mode 300. When implementing the neutral control mode 300, the transmission control unit 500 shifts the transmission 600 to the neutral stage by a signal received from the control unit 400.

The control unit 400 calculates the inertia travelable time from the distance and the relative speed with the preceding vehicle. When the inertia travelable time calculated in the control unit 400 is equal to or greater than the target value and it is determined that the compression ratio is required to be changed, the compression ratio changing unit 200 changes the compression ratio. The control unit 400 determines whether the compression ratio is required to be changed based on a compression ratio changing request map.

In some forms of the present disclosure, the variable compression ratio-applied control system using the ADAS configured as described above, since the compression ratio is changed during inertia traveling during which the neutral control mode has been implemented, the impact due to the fluctuation of the compression ratio is not transferred to the driver and an engine operating sound is small, such that it is difficult for the driver to recognize a change in the engine operating sound. Therefore, the driver feels no sense of heterogeneity suspicious of the vehicle failure when the compression ratio is changed.

Figure 5:
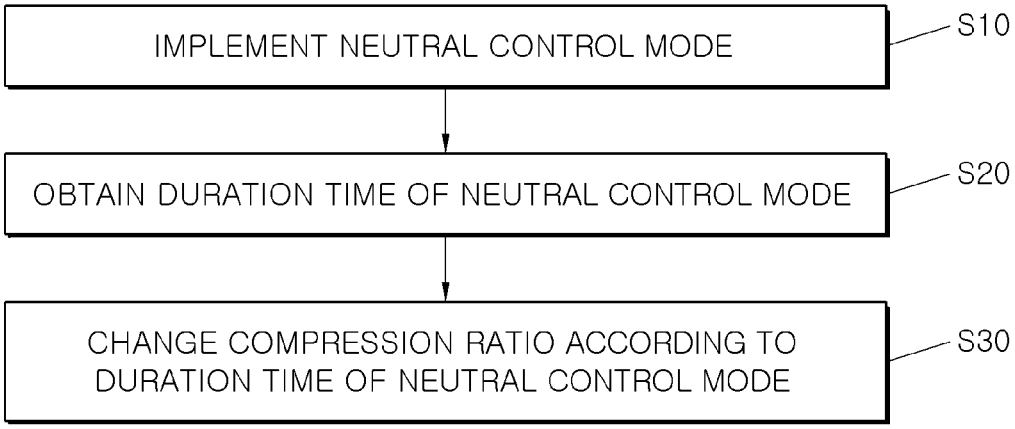
FIG. 5 is a flowchart illustrating a variable compression ratio-applied control method using an ADAS in one form of the present disclosure.
Figure 6A:
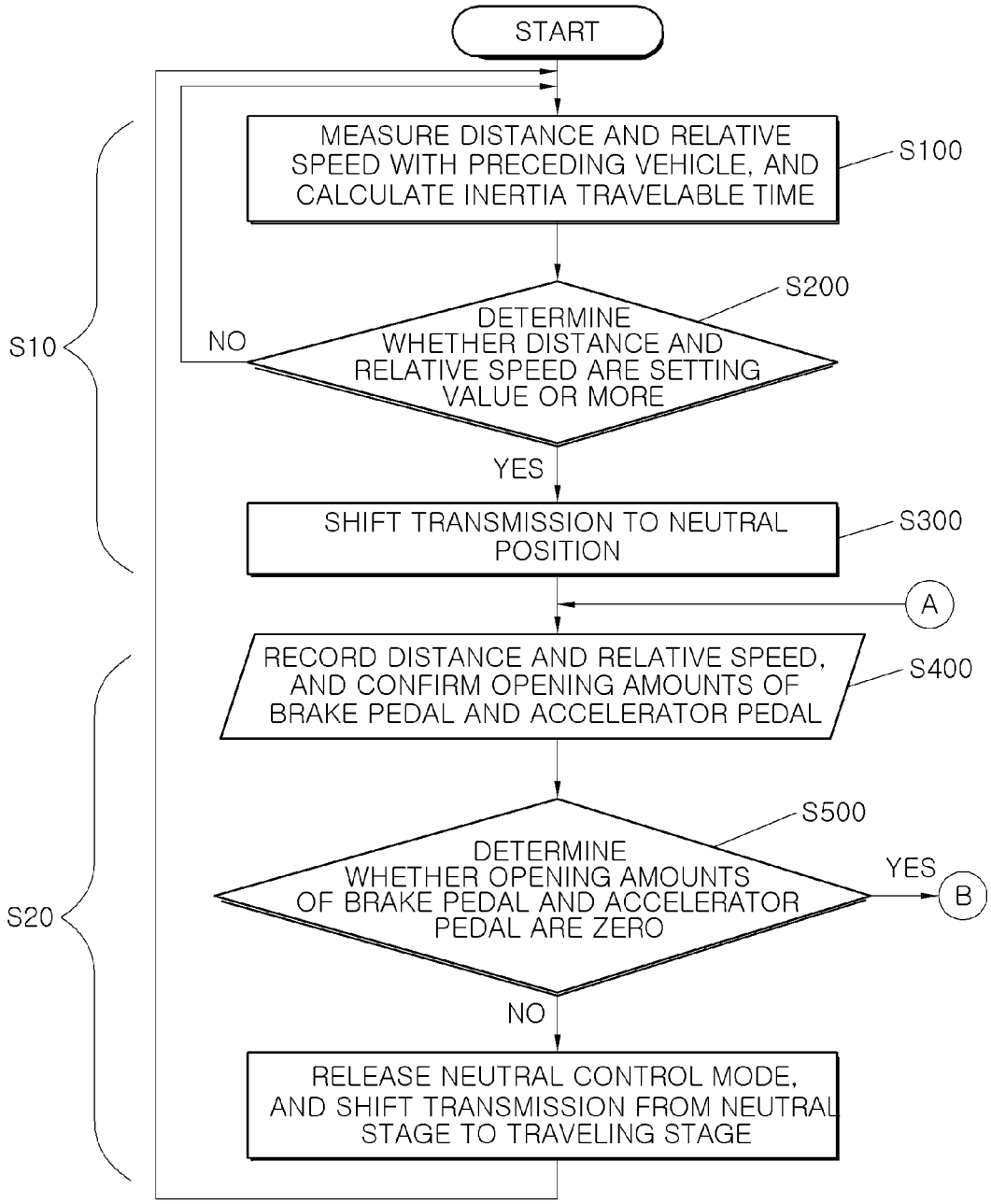
FIG. 6A and FIG. 6B are flowcharts illustrating a variable compression ratio-applied control method using an ADAS in one form of the present disclosure.
Figure 6B:
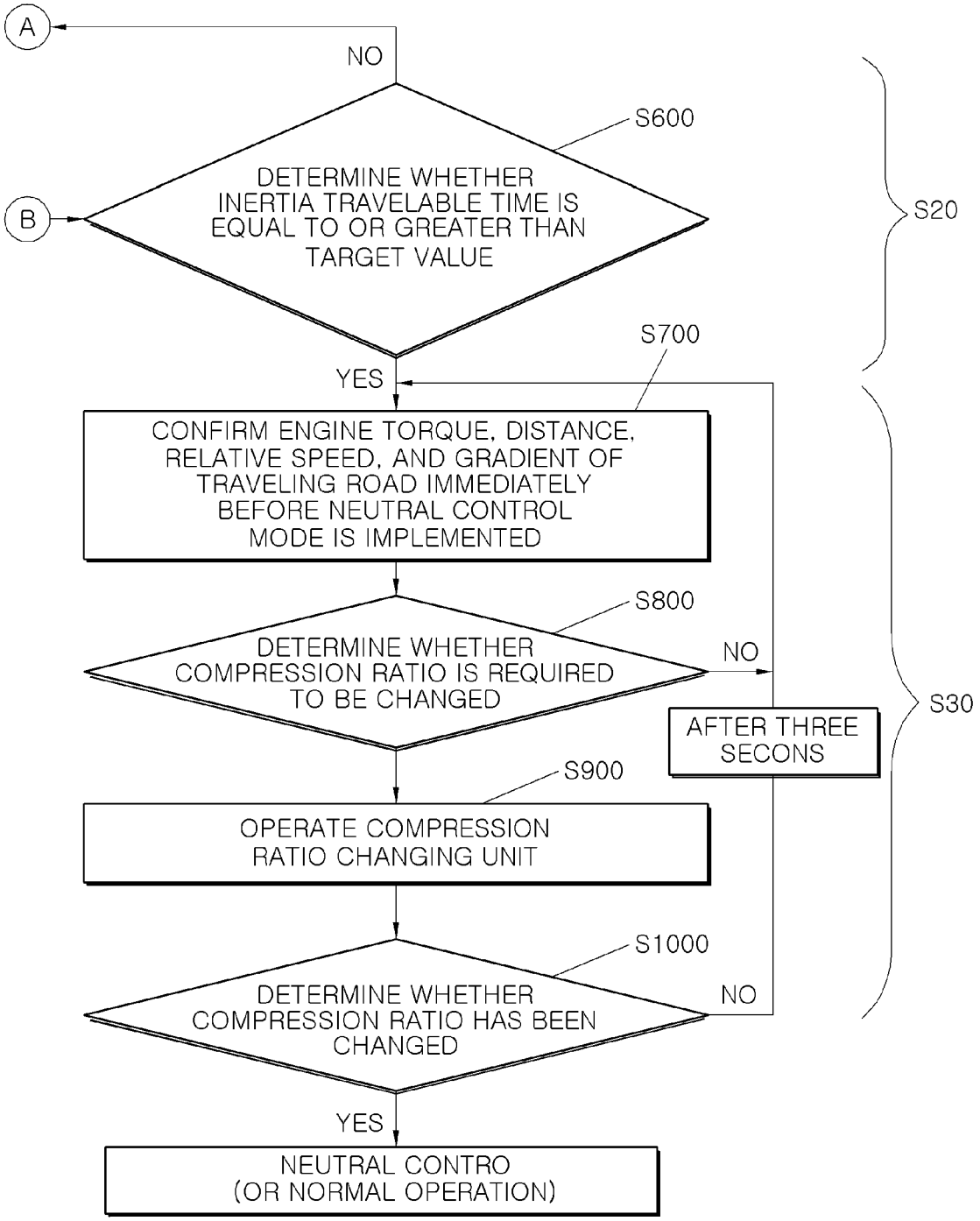

As illustrated in FIGS. 5 and 6, a variable compression ratio-applied control method using an ADAS in some forms of the present disclosure includes implementing a neutral control mode 300 during inertia traveling S10, obtaining the duration time of the neutral control mode 300 S20, and changing a compression ratio according to the duration time of the neutral control mode 300 S30.

The implementing the neutral control mode 300 for blocking the power transfer by the transmission during traveling S10 includes measuring the distance and the relative speed with a preceding vehicle through the driver assist unit 100, and calculating an inertia travelable time S100, determining whether the distance and the relative speed with the preceding vehicle are equal to or greater than a setting value S200, and shifting the transmission 600 to the neutral position S300.

The obtaining the duration time of the neutral control mode 300 S20 includes recording the distance and the relative speed with the preceding vehicle, and confirming the opening amounts of the brake pedal and the accelerator pedal S400, determining whether the opening amounts of the brake pedal and the accelerator pedal are zero S500, and determining whether the inertia traveling time is equal to or greater than a target value S600.

The target value is arbitrarily decided by an engineer. In addition, the start timing at which an operation of the compression ratio changing unit 200 is started after an operation of the neutral control mode 300 is arbitrarily determined by the engineer as well. The stop timing at which the operation of the compression ratio changing unit 200 is stopped is arbitrarily determined by the engineer as well so that the change in the compression ratio by the compression ratio changing unit 200 may be stopped before the neutral control mode 200 is stopped. When reaching the stop timing, the operation of the compression ratio changing unit 200 is stopped so that current compression ratio is kept, or stopped after being finally operated so that it becomes a predetermined compression ratio.

In the determining whether the opening amount of the pedal is zero S500, the neutral control mode 300 is released, and the transmission 600 is changed from the neutral stage to the driving stage when it is determined that the opening amounts of the brake pedal and the accelerator pedal are not zero. Then, the required torque necessary for traveling is confirmed.

In the determining whether the inertial travelable time is equal to or greater than the target value S600, the recording the distance and the relative speed with the preceding vehicle, and confirming the opening amounts of the brake pedal and the accelerator pedal S400 is performed again, when the inertial travelable time is smaller than the target value. In the determining whether the inertia travelable time is equal to or greater than the target value S600, changing the compression ratio S30 is performed when the inertial travelable time is equal to or greater than the target value.

The changing the compression ratio S30 includes confirming the engine torque, the distance and the relative speed with the preceding vehicle, and the gradient of the traveling road immediately before the neutral control mode 300 is implemented S700, determining whether the compression ratio is required to be changed S800, operating the compression ratio changing unit 200, and changing the compression ratio S900, and determining whether the compression ratio has been changed S1000.

The confirming that the engine torque, the distance and the relative speed with the preceding vehicle, and the gradient of the traveling road immediately before the neutral control mode 300 is implemented S700 confirms the distance and the relative speed with the preceding vehicle and the gradient of the traveling road measured in real time. Unlike the above, it can also confirm the distance and the relative speed with the preceding vehicle measured in the measuring the distance and the relative speed with the preceding vehicle and calculating the inertia travelable time S100 through the driver assist unit 100 as described above.

In the determining whether the compression ratio is required to be changed S800, it is determined whether the compression ratio is required to be changed based on a compression ratio changing request map. The compression ratio changing request map is formed so that a target compression ratio is obtained by using as variables the engine torque, the distance and the relative speed with the preceding vehicle, and the gradient of the traveling road immediately before the neutral control mode 300 is implemented.

According an example, in the determining whether the compression ratio is required to be changed S800, the control unit 400 can also determine that the compression ratio is required to be changed to be reduced when it is determined to be accelerated or travelled at a high speed, it is determined to be currently traveling after rapid acceleration, it is determined to be currently in the long uphill traveling state, or it is determined to be traveling in a cold condition.

At this time, the determination condition can be input to the control unit 400 by the engineer. For example, the engineer can input the determination condition to the control unit 400 so as to determine that it accelerates or travels at a high speed, when the vehicle speed immediately before the neutral control mode 300 is implemented was 80 km/h or more, the relative speed with the preceding vehicle is 0 or less immediately after the neutral control mode 300 has been implemented, or the distance with the preceding vehicle is 30 m or more immediately after the neutral control mode 300 has been implemented. In addition, the engineer can input the determination condition to the control unit 400 so as to determine that it is traveling in the cold condition, when the temperature of the coolant is 60° C. or less, and the outside air temperature is 0° C. or less.

According to an example, in the determining whether the compression ratio is required to be changed S800, the control unit 400 can determine that the compression ratio is required to be changed to be increased, when it is determined to be decelerated or traveled at low speed, it is determined to be currently traveling after rapid deceleration, or it is determined to be currently in the long downhill traveling state.

At this time, the determination condition can be input to the control unit 400 by the engineer. For example, the engineer can input the determination condition to the control unit 400 so as to determine that it decelerates or travels at a low speed, when the vehicle speed immediately before the neutral control mode 300 is implemented was 80 km/h or less, the relative speed with the preceding vehicle is 0 or more immediately after the neutral control mode 300 has been implemented, or the distance with the preceding vehicle is 30 m or less immediately after the neutral control mode 300 has been implemented.

In the determining whether the compression ratio is required to be changed S800, when it is determined that the compression ratio is not required to be changed, the confirming the engine torque, the distance and the relative speed with the preceding vehicle, and the gradient of the traveling road immediately before the neutral control mode is implemented S700 is performed again.

Meanwhile, in the operating the compression ratio changing unit 200 and changing the compression ratio S900, the actuator mounted on the compression ratio changing unit 200 is operated. Each link constituting the link structure is relatively rotated by the operation of the actuator. When the compression ratio is increased, the hinge for connecting the piston and the connecting rod moves to the connecting rod side, thereby shortening the stroke of the piston head. When the compression ratio is increased, the hinge for connecting the piston and the connecting rod moves to the piston side, thereby lengthening the stroke of the piston head.

In the determining whether the compression ratio has been changed S1000, when it is determined that the compression ratio has not been changed, the confirming the engine torque, the distance and the relative speed with the preceding vehicle, and the gradient of the traveling road immediately before the neutral control mode 300 is implemented S700 is performed again after three seconds standby. In the determining whether the compression ratio has been changed S1000, when it is determined that the compression ratio has been changed, the compression ratio can be kept until it becomes the above-described stop timing. Alternatively, when the inertia traveling is terminated by the pedal operation of the driver earlier than the calculated inertia traveling holding time, the compression ratio can be changed according to the required torque.

In some forms of the present disclosure, the variable compression ratio-applied control system using the ADAS configured as described above and the control method, since the compression ratio is changed during inertial traveling during which the neutral control mode has been implemented, the impact due to the change in the compression ratio is not transferred to the driver, and it is difficult for the driver to recognize the change in the engine operating sound because the engine operating sound is small. Therefore, the driver feels no sense of heterogeneity suspicious of the vehicle failure when the compression ratio is changed.

In addition, since the compression ratio is changed during the neutral control mode 300 in which the engine load is small, the mechanical load is inhibited when the compression ratio is changed, thereby minimizing abrasion and damage of the compression ratio changing unit 200 and the engine.

In addition, since it is determined whether the compression ratio is required to be changed from the information acquired through the driver assist unit 100, the compression ratio changing point can be optimized. In addition, since the variable compression ratio holding time is improved, the fuel efficiency due to the increase in the compression ratio at the engine low load is also enhanced.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A variable compression ratio-applied control system using an Advanced Driver-Assistance Systems (ADAS), comprising:

a driver assist unit configured to measure vehicle surroundings;

a compression ratio changing unit configured to change a compression ratio; and a control unit configured to implement a neutral control mode, wherein the control unit is further configured to:

implement the neutral control mode during an inertia traveling;

determine whether to change the compression ratio based on a distance from a preceding vehicle and a relative speed against the preceding vehicle that are acquired by the driver assist unit; and calculate an inertia travelable time based on the distance from the preceding vehicle and the relative speed against the preceding vehicle.

2. The system of claim 1, wherein the control unit is configured to:

implement the neutral control mode when the distance from the preceding vehicle and the relative speed against the preceding vehicle are equal to or greater than a predetermined value.

3. The system of claim 1, wherein the compression ratio changing unit is configured to:

change the compression ratio when the calculated inertia travelable time is equal to or greater than a target value and the compression ratio is determined to be changed.

4. The system of claim 3, wherein the control unit is configured to:

determine whether to change the compression ratio based on a compression ratio changing request map.

5. The system of claim 3, wherein the control unit is configured to receive the target value through a calibration.

6. The system of claim 5, wherein the target value is a time value between a start time that the compression ratio changing unit starts and a stop time that the compression ratio changing unit stops.

7. A variable compression ratio-applied control method using an Advanced Driver-Assistance Systems (ADAS), comprising:

implementing a neutral control mode during an inertia traveling;

obtaining a duration time of the neutral control mode; and changing a compression ratio based on the duration time of the neutral control mode, wherein implementing the neutral control mode comprises:

measuring a distance from a preceding vehicle and a relative speed against the preceding vehicle;

calculating an inertia travelable time;

determining whether the distance from the preceding vehicle and the relative speed against the preceding vehicle are equal to or greater than a predetermined value; and shifting to a neutral position.

8. The method of claim 7, wherein obtaining the duration time of the neutral control mode comprises:

recording the distance from the preceding vehicle and the relative speed against the preceding vehicle;

checking opening amounts of a brake pedal and an accelerator pedal;

determining whether the opening amounts of the brake pedal and the accelerator pedal are zero; and determining whether the inertia travelable time is equal to or greater than a target value.

9. The method of claim 8, wherein determining whether the opening amounts of the brake pedal and the accelerator pedal are zero comprises:

when it is determined that the opening amounts of the brake pedal and the accelerator pedal are not zero, releasing the neutral control mode and checking a required torque necessary for traveling.

10. The method of claim 8, wherein determining whether the inertia travelable time is equal to or greater than the target value comprises:

when the inertia travelable time is less than the target value, recording the distance from the preceding vehicle and the relative speed against the preceding vehicle and checking the opening amounts of the brake pedal and the accelerator pedal.

11. The method of claim 7, wherein changing the compression ratio comprises:

checking an engine torque, the distance from the preceding vehicle, the relative speed against the preceding vehicle, and a gradient of a traveling road immediately before the neutral control mode is implemented;

determining whether the compression ratio is required to be changed;

changing the compression ratio by a compression ratio changing unit; and confirming whether the compression ratio has been changed.

12. The method of claim 11, wherein determining whether the compression ratio is required to be changed comprises:

when it is determined that the compression ratio is not required to be changed, checking the engine torque, the distance from the preceding vehicle, the relative speed against the preceding vehicle, and the gradient of the traveling road immediately before the neutral control mode is implemented.

13. The method of claim 11, wherein confirming whether the compression ratio has been changed comprises:

when it is confirmed that the compression ratio has not been changed, checking, after a predetermined amount of time, the engine torque, the distance from the preceding vehicle, the relative speed against the preceding vehicle, and the gradient of the traveling road immediately before the neutral control mode is implemented.

14. The method of claim 11, wherein determining whether the compression ratio is required to be changed is based on a compression ratio changing request map.

15. The method of claim 11, wherein determining whether the compression ratio is required to be changed comprises:

determining the compression ratio is required to be reduced when:

a vehicle accelerates or travels at a high speed;

the vehicle currently travels after a rapid acceleration;

the vehicle currently travels on a long uphill; or the vehicle travels in a cold condition.

16. The method of claim 11, wherein determining whether the compression ratio is required to be changed comprises:

determining the compression ratio is required to be increased when:

the vehicle decelerates or travels at a low speed;

the vehicle currently travels after a rapid deceleration; or the vehicle currently travels on a long downhill.

* * * * *